United States Patent [19]

Goldenberg et al.

[11] Patent Number: 4,555,888

[45] Date of Patent: Dec. 3, 1985

[54] PREFORMED, REINFORCED STRUCTURAL PANELS AND METHOD OF MAKING SAME

[76] Inventors: Joseph Goldenberg, 1707 East West Hwy., Hyattsville, Md. 20783; Joseph Cooke, 1015 Chestnut St., Philadelphia, Pa. 19103

[21] Appl. No.: 447,108

[22] Filed: Dec. 6, 1982

[51] Int. Cl.[4] ..... E04B 2/56

[52] U.S. Cl. ..... 52/722; 52/602; 264/464

[58] Field of Search ..... 52/600, 602, 722, 723, 52/327, 741; 264/228, 46.4, 46.7

[56] References Cited

U.S. PATENT DOCUMENTS

| | | | |
|---|---|---|---|
| 2,428,304 | 9/1947 | Abeles et al. | 52/722 |
| 2,945,328 | 7/1960 | Webb | 52/327 |
| 3,475,529 | 10/1969 | Lacy | 52/602 X |
| 3,546,830 | 12/1970 | Villaneau | 52/602 X |
| 4,244,901 | 1/1981 | Wencley et al. | 52/602 |
| 4,387,544 | 6/1983 | Schilger | 52/600 |

FOREIGN PATENT DOCUMENTS

| | | | |
|---|---|---|---|
| 2252023 | 5/1974 | Fed. Rep. of Germany | 52/602 |
| 2413645 | 9/1975 | Fed. Rep. of Germany | 52/602 |
| 2415647 | 10/1975 | Fed. Rep. of Germany | 52/602 |
| 2600662 | 7/1977 | Fed. Rep. of Germany | 52/602 |
| 2239569 | 2/1975 | France | 52/722 |
| WO83/03276 | 9/1983 | PCT Int'l Appl. | 52/602 |

*Primary Examiner*—J. Karl Bell

*Attorney, Agent, or Firm*—Haight & Associates

[57] ABSTRACT

A method is disclosed for forming reinforced concrete structural panels wherein one or more preformed elongated structural ribs are inverted and placed horizontally into a form for casting a generally flat concrete structural slab. The structural ribs have joiners projecting downward into the form and the concrete slab which is cast in the form so that the joiners connect the reinforced ribs with the slab. In one embodiment of the invention a plurality of reinforced elongated ribs are disposed parallel to one another in the form and additional reinforcing members placed in the form perpendicular to the ends of the ribs to form a box-like structure. A plurality of these reinforced structural panels can be connected together by stringers run through the end members.

20 Claims, 9 Drawing Figures

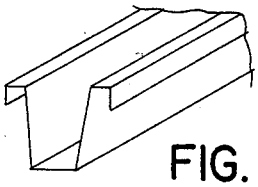
FIG. 1a
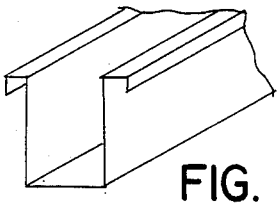
FIG. 1b
FIG.2
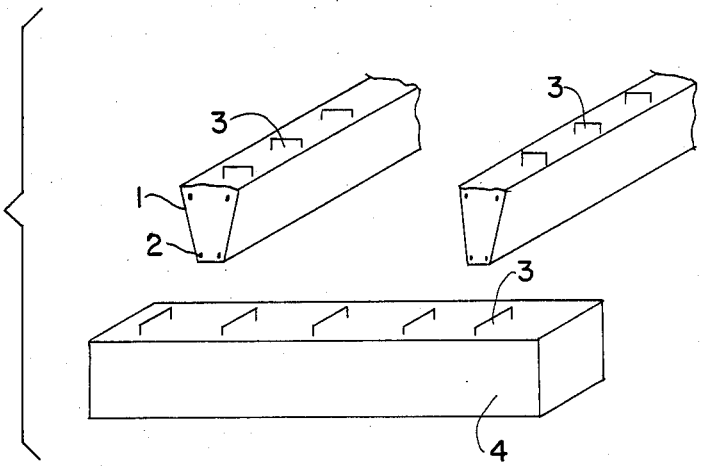
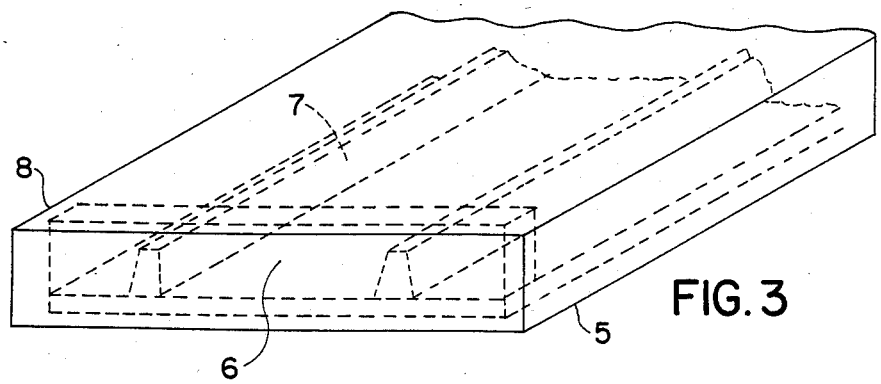
FIG. 3

PREFORMED, REINFORCED STRUCTURAL PANELS AND METHOD OF MAKING SAME

TECHNICAL FIELD OF THE INVENTION

The present invention is directed to a method of forming reinforced structural panels, and, more specifically, to a method for forming prestressed concrete panels in which the reinforcing members are formed independently of the slab portion of the panel. The invention is particularly characterized by its flexibility in permitting the fabrication of reinforced panels of a variety of shapes and sizes including panels which can be joined together by post-tensioning to form large structured units or individual reinforced panels having reinforcing members as required for particular application.

BACKGROUND OF THE INVENTION

Precast concrete structural panels and beams having reinforcing ribs are known in the art. Such panels are typically prepared by casting both the flat slab portion of the panel and the reinforcing ribs in a single mold at the same time with pretensioned reinforcing rods being present in the ribs and the slab itself.

Such precast reinforced panels have certain inherent deficiencies however. Since the entire panel is cast in a single mold at a single time, there is an obvious lack of versatility or ability to alter the size and configuration of the panel. Either the panel must be used in the size and configuration in which it is cast or a number of different molds provided so that different size panels of different configuration can be prepared. Obviously this is expensive and beyond the means of most fabricating units.

Further, since the ribs which reinforce the flat slab of the panel contain tendons or wires which are under tension at the time the unit is cast, subsequent relaxation of this tension frequently produces a camber or bowing in the panel. This is of course undesirable where a perfectly flat surface is required.

Typically, also, when precast and pretensioned structural panels having reinforcing ribs are fabricated, the portion of the mold which forms the reinforcing ribs is on the bottom of the mold unit and the concrete is poured first into the molds for the ribs and then after these molds are filled into the rest of the mold to form the slab itself. Thus, the panel is in effect cast "bottom up" with the bottom surface of the panel facing up which requires that it subsequently be finished or smoothed to the desired texture.

DISCLOSURE OF THE INVENTION

It is accordingly an object of the present invention to provide a method for fabricating precast, reinforced concrete structural panels which can be formed easily to have different configurations and sizes without the need for a large number of individual molds.

It is a further object of the present invention to provide a precast reinforced structural concrete panel which essentially eliminates the problem of camber or bowing which occurs in precast reinforced panels of the prior art.

It is yet a further object of the present invention to provide a method for preparing precast structural panels which permit the bottom surface of the panel to be cast to have a desired texture or finish without the need for significant further preparation.

Yet another object of the present invention is to provide precast reinforced concrete structural panels which are more economical and versatile in their configuration than reinforced structural panels of the prior art and which can easily be fabricated to have varying numbers of reinforcing ribs as well as different sizes and configurations which have not heretofore been possible without using separate molds for casting the units.

A further object of the present invention is to provide precast reinforcing concrete structural panels which allow for assembly of structural units comprised of all or portions of these panels, which can form framing systems that can be used both as primary and secondary systems and which are far less structured than those precast systems previously manufactured, and which permit the use of precast concrete in a variety of uses previously requiring and restricted to the use of field formed and poured concrete.

BRIEF DESCRIPTION OF THE DRAWINGS

FIG. 1A is a perspective view of a portion of the form used for casting the elongated reinforcing ribs of the invention.

FIG. 1B is a perspective view of a portion of the form used for casting the diaphragm or end members of the invention.

FIG. 2 illustrates in perspective the preformed ribs of and diaphragm piece of the invention.

FIG. 3 illustrates the slab, reinforcing ribs and diaphragm before removal from the slab form.

BEST MODE FOR CARRYING OUT THE INVENTION

Figure 4:
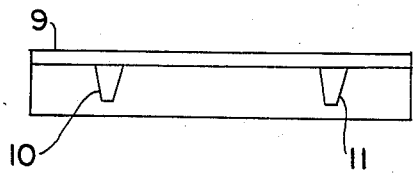
FIG. 4 is a front end view of a reinforced panel of the invention.

The above and other objectives are achieved in accordance with the present invention which is a process whereby one or more preformed elongated structural ribs which have a plurality of joiners projecting from a common side of each rib are placed downward into a mold for casting a generally flat slab. Each of the preformed structural ribs is disposed horizontally in the mold in accordance with desired spacing and orientation. The joiners, which typically are wire loops projecting from one side of the structural rib, are disposed to project downward into the bottom of the mold where the flat slab will be cast. Various known means can be employed for maintaining the correct desired alignment of the preformed structural ribs in the mold as well as the proper depth of penetration into the bottom of the mold of the joiners and the structural ribs themselves.

In one embodiment of the present invention, once the desired structural ribs are emplaced in the form concrete is then poured into the bottom to form the slab itself. This concrete slab envelopes the joiners extending from the downwardly disposed side or edge of the rib members as well as a portion of the downward projecting end of the elongated ribs. In another embodiment of the present invention the flat concrete slab is cast first and the various reinforcing ribs impressed into the wet uncured concrete while it is still soft.

Preforming of the structural ribs which are employed in accordance with the present invention is carried out using a separate form which typically is of rectangular or U-shaped cross section, although it will be understood that other cross section configurations can be used in accordance with the present invention. Joiners can be implanted into the top edge of the elongated structural ribs while still wet in the form or emplaced before the concrete is actually cast. Although typically the joiners can take the shape of wire loops, it will be understood by those skilled in the art that various other devices such as bolts or rods could similarly be used. It will also be understood that the structural ribs which are preformed in accordance with the present invention will typically have embedded within them pretensioned cables or tendons which are disposed longitudinally under tension in the mold prior to casting of concrete with the tension being relaxed once the concrete has set.

In a further embodiment of the present invention, the side of the reinforced panel opposite the side to which the reinforcing ribs are affixed can be provided with a desired texture of finish by providing a corresponding finish or texture on the inside of the form into which the panel itself is cast. Since, in accordance with the present invention, the structural panel is cast face down into the mold with the reinforcing ribs being present on the upper surface of the cast panel, the bottom or "outside" face of the reinforced panel can assume the texture and surface finish of the bottom of the panel mold as opposed to the practice of the prior art in which the panels are typically cast face up.

It will further be appreciated that in accordance with the present invention the preformed elongated structural ribs can be disposed horizontally in the mold for casting the concrete slab in any desired orientation or number. Thus, for a given slab, any number of reinforcing ribs can be employed without requiring a different mold. Further, since a number of reinforcing ribs can be used as desired, the height and relative size of the reinforcing ribs themselves can be varied to accommodate structural requirements. Although it will be frequently be the case that the reinforcing ribs will be disposed in parallel rows, this is by no means required in accordance with the present invention which permits the reinforcing ribs to be oriented in any configuration such as radially as the spokes of a wheel if the panel being cast, for example, is circular.

In a particularly preferred embodiment of the present invention, a plurality of elongated reinforcing ribs are disposed parallel to one another in the mold with the ends of the reinforcing ribs terminating on a common line. Additional elongated ribs having rectangular cross section are disposed across the respective ends of the structural ribs so as to form a "T" across these ends. Advantageously, the reinforcing ribs of rectangular cross section which are perpendicular to the ends of the other reinforcing ribs extend essentially to the sides of the form box-like for the slab itself. In this way, the reinforced panels when completed form units which can be joined together by tendons passing through the end members to form structures of desired length.

Optionally, the reinforcing ribs can be dispensed with altogether and only the rectangular cross-section ribs or "diaphragms" employed along opposing sides of the slab to permit joining together of a series of such slabs by means of the tendons extending through the respective diaphragms which abutt one another end to end.

Thus, it will be appreciated by those skilled in the art that a principal feature and advantage of the present invention is the flexibility which is achieved by manufacturing the rib members independently of the slab as described herein. For example, the invention contemplates of various shapes, slabs, with or without one or more cross-ribs or "diaphragms" to permit post-tensioning by running a joiner tendon through the respective members. The invention further contemplates slabs that may or may not employ reinforcing ribs as required and which may or may not be pre-stressed. Where reinforcing ribs or diaphragms are used, they also can be positioned on either side of the slab, which in some cases may not be flat or planar.

The present invention will however be further appreciated by having reference to the appended drawings.

Directing attention to the drawings, FIGS. 1A and 1B illustrate respective forms for casting the prestressed ribs and ends or diaphragms employed perpendicular to the ends of the horizontally disposed reinforcing ribs. It will be seen that the form 1A used for casting the rib members has a tapered cross section whereas the form for casting the end pieces or diaphragm has a rectangular cross section.

FIG. 2 illustrates the precast ribs and end pieces of the present invention. Concrete precast ribs 1 are shown having pretensioned reinforcing rods or tendons 2 implanted longitudinally therein. Joiner loops 3, which may be of wire or similar material, are shown implanted in the tops of the rib members as they are removed from the mold. The end members or diaphragm are shown at 4 having a rectangular cross section and having similar joiner loops 3 implanted therein.

FIG. 3 illustrates a panel of the present invention emplaced in a form for the slab 5. The precast, prestressed reinforcing ribs 7 are disposed face down longitudinally and parallel to one another in the mold so that the joiners which are not shown are embedded within the cast slab 6. The end member or diaphragm 8 is disposed also face down across the ends of the prestressed ribs with similar joiners implanted in the concrete slab 6 prior to the slab curing.

Figure 6:
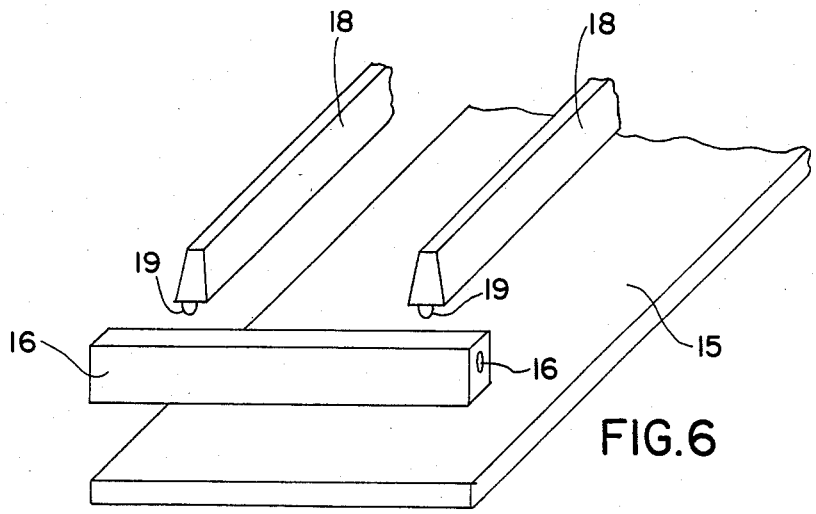
FIG. 6 is a disassembled perspective view of a reinforced panel of the invention.

FIG. 6 illustrates the component members of a preformed, reinforced structural panel of the present invention. The concrete slab 15 is shown having a generally rectangular configuration. Reinforcing ribs 18 are longitudinally disposed with respect to the slab and parallel to one another with joiners 19 projecting downward to be embedded in the slab 15 while the concrete is in an unhardened condition. The end rib or diaphragm 16 is shown having a passage provided at 16 longitudinally thereto for insertion of a post-tensioning cable or rod so that the entire unit can be connected with similar units to form a unitary panel as shown in FIG. 7.

In FIG. 4 a precast, reinforced panel of the present invention is shown subsequent to removal from the form used for casting the slab. The panel is inverted so that the attached reinforcing ribs 10 and 11 are disposed downward. The top surface 9 of the panel will have the texture and finish imparted by the bottom of the form in which the panel was cast without significant finishing of that surface being required. It will further be understood that the distance between the reinforcing ribs 10 and 11 can be varied as desired as well as the number of such ribs and their size.

Figure 5:
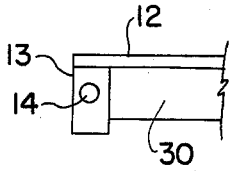
FIG. 5 is a side view showing the diaphragm and rib with post tensioning passage.

FIG. 5 illustrates the positioning of the end rib or diaphragm 13 at the edge of the panel 12 abutting precast rib 30. A longitudinal passage 14 is provided extending through the length of the diaphragm 13 to permit insertion of a rod or tendon to connect the panel with similar panels.

Figure 7:
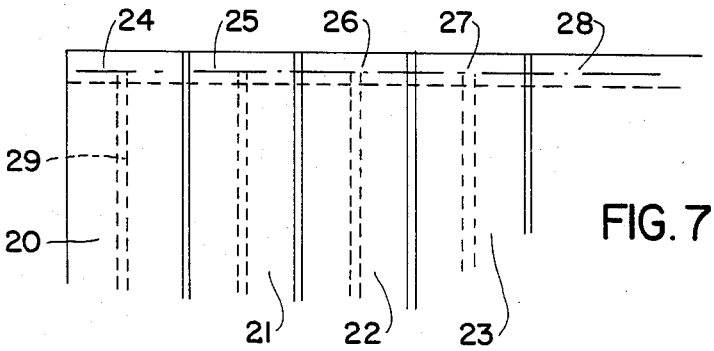
FIG. 7 is a side view showing a series of reinforced panels connected to form a structural beam.

In FIG. 7 a series of preformed, reinforced panels 20, 21, 22 and 23 are shown disposed side by side to form a single extended structure. Reinforcing ribs 29 in the respective panels terminate in diaphragm or end ribs 24, 25, 26, 27 and 28 which are connected by means of a post-tensioning cable or rod extending through each of the end members thereby connecting the respective preformed panels to form a beam of desired length.

Figure 8:
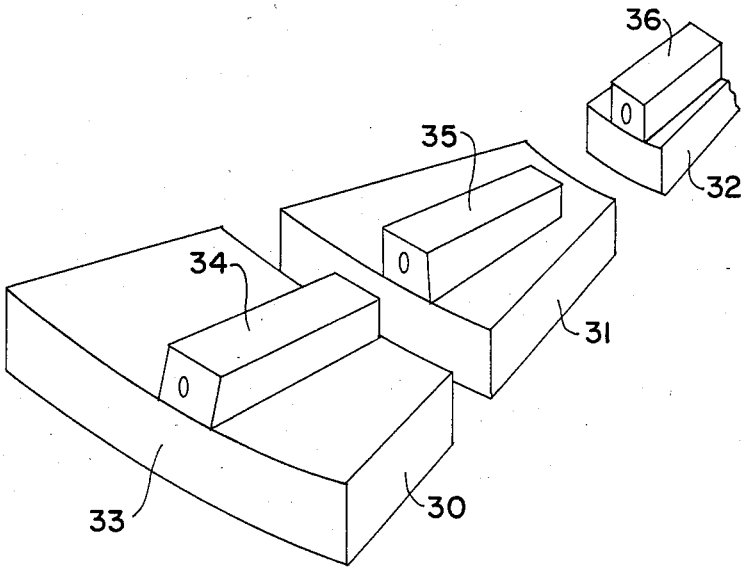
FIG. 8 is a perspective view of a series of wedge shaped panels adapted to be post-tensioned together to form a single unit.

FIG. 8 illustrates a series of wedge shape slabs, 30, 31 and 32 each provided with a rib, 34, 35, 36 respectively and adapted to be post-tensioned together by means of a common tendon 33 extending through each rib. Similar slabs of varying configurations can also be provided each with one or more rib members disposed to align properly when the slabs are joined to permit post-tensioning by means of common tendons.

It will be appreciated by those of ordinary skill in the art that the present invention may readily be adapted to various desired configurations and size structures without departing from the intended scope of the present invention.

INDUSTRIAL APPLICABILITY

As can be seen from the present specification, this invention is industrially useful in building and related construction technology.

What is claimed is:

1. A method for forming a reinforced concrete structural panel having a finished slab surface and an opposed slab surface to which at least one pre-stressed structural reinforcing member is reinforcingly abutted, which comprises:

(a) casting concrete into a mold having a molding surface corresponding to a desired finished slab shape and surface texture to form an uncured concrete slab;

(b) implanting a plurality of joiner means projecting from a surface of at least one longitudinally pre-stressed structural reinforcing member into the uncured concrete slab to abut the uncured slab against the pre-stressed reinforcing member along the surface of the reinforcing member from which the joiner means project; and (c) curing the concrete slab without pre-stressing it while the joiner means is thusly implanted to form said reinforced concrete structural panel.

2. A method according to claim 1, wherein the joiner means are implanted by positioning the reinforcing member over the uncured concrete slab with the joiner means projecting into the slab.

3. A method according to claim 2, wherein the mold is an open mold and the joiner means are implanted into the unmolded surface of the uncured concrete slab.

4. A method according to claim 1, wherein the pre-stressed structural reinforcing member is a structural rib.

5. A method according to claim 4, wherein a plurality of said ribs are disposed parallel to one another.

6. A method according to claim 4, wherein the desired finished slab shape is flat.

7. A method according to claim 4, wherein the desired finished slab surface is smooth.

8. A method according to claim 4, wherein the pre-stressed structural rib has a generally quadrangular cross-section transverse to its longitudinal axis and is generally flat along its ends.

9. A method according to claim 8, further comprising removing the cured structural panel from the mold and forming a second such structural panel having a different arrangement of pre-stressed structural reinforcing members from the same mold.

10. A method according to claim 4, further comprising implanting a plurality of additional joiner means projecting from a surface of at least one hollow post-tensioning structural member into the uncured concrete slab to abut the uncured slab against the post-tensioning structural member along the surface of said member from which the joiner means project.

11. A method according to claim 10, wherein the post-tensioning structural member is generally perpendicular to the pre-stressed structural reinforcing member.

12. A method according to claim 11, wherein the structural panel is rectangular.

13. A method according to claim 10, wherein the post-tensioning structural member is aligned on the slab to abut end-to-end with a similar member on another slab to permit a common post-tensioning means to pass through both members and join both slabs together.

14. A method according to claim 13, wherein the structural panel is wedge-shaped.

15. A method according to claim 13, wherein the desired finished slab shape is flat, the desired finished slab surface texture is smooth, and the pre-stressed structural member and the post-tensioning structural members each have a generally quadrangular cross-section transverse to their respective longitudinal axes and are generally flat along their respective ends.

16. A reinforced concrete structural panel characterized by having a molded finished surface opposite a surface against which a pre-stressed structural reinforcing member is abutted, comprising:

(a) a concrete slab which has been cured without pre-stressing and which has a finished slab surface and an opposed slab surface to which at least one pre-stressed structural reinforcing member is reinforcingly abutted; and (b) a plurality of joiner means reinforcingly engaging said slab with said reinforcing member.

17. A reinforced concrete structural panel according to claim 16, wherein the pre-stressed structural reinforcing member is a structural rib and the finished surface is flat.

18. A reinforced concrete structural panel according to claim 16, further comprising a plurality of additional joiner means projecting from a surface of at least one hollow post-tensioning structural member into the concrete slab to abut the slab against the post-tensioning structural member along the surface of said member from which the joiner means project.

19. A reinforced concrete structural panel according to claim 18, wherein the pre-stressed structural reinforcing member is a structural rib and the finished surface is flat.

20. A plurality of reinforced concrete structural panels according to claim 18 wherein each post-tensioning structural member is aligned on the slab to abut end-to-end with a similar member on another slab and a common post-tensioning means passes through said members to join said slabs together.

* * * * *